US006157287A

United States Patent [19]

Douglass et al.

[11] Patent Number: 6,157,287

[45] Date of Patent: Dec. 5, 2000

[54] TOUCH SAFE FUSE MODULE AND HOLDER

[75] Inventors: Robert Stephen Douglass, Wildwood, Mo.; Matthew Rain Darr, Godfrey, Ill.; Daniel Eugene Rowton, Wildwood, Mo.

[73] Assignee: Cooper Technologies Company, Houston, Tex.

[21] Appl. No.: 09/261,208

[22] Filed: Mar. 3, 1999

[51] Int. Cl.[7] ..... H01H 85/22; H01H 85/02; H01H 85/20

[52] U.S. Cl. ..... 337/198; 337/186; 337/197; 337/194; 337/159; 361/833; 361/835

[58] Field of Search ..... 337/198, 194, 337/186, 197, 260, 159, 264, 255, 227, 268, 269, 271, 290, 295, 262, 241, 251, 216, 208, 163, 265, 168, 179, 192, 206, 211, 213, 222; 361/104, 833–835

[56] References Cited

U.S. PATENT DOCUMENTS

| | | | |
|---|---|---|---|
| 1,486,791 | 3/1924 | Nutt | 439/862 |
| 1,552,971 | 9/1925 | Unger . | |
| 1,860,546 | 5/1932 | Manson | 337/197 |
| 2,091,204 | 8/1937 | Horn . | |
| 2,177,592 | 10/1939 | Del Camp | 337/198 |
| 2,204,948 | 6/1940 | Pond | 337/226 |
| 2,644,056 | 6/1953 | Curtis . | |
| 2,644,057 | 6/1953 | Curtis | 337/197 |
| 3,056,870 | 10/1962 | Andres | 337/196 |
| 3,189,712 | 6/1965 | Kozacka . | |
| 3,202,788 | 8/1965 | George | 337/194 |
| 3,229,066 | 1/1966 | Rowe . | |
| 3,261,950 | 7/1966 | Kozacka . | |
| 3,261,952 | 7/1966 | Kozacka . | |
| 3,671,910 | 6/1972 | Kozacka . | |
| 3,697,916 | 10/1972 | Belcher et al. . | |
| 3,713,064 | 1/1973 | Jacobs, Jr. . | |
| 3,732,516 | 5/1973 | Puetz . | |
| 3,764,949 | 10/1973 | Swain . | |
| 3,766,507 | 10/1973 | Jacobs, Jr. . | |
| 3,783,428 | 1/1974 | Swain et al. . | |
| 3,824,520 | 7/1974 | Knapp, Jr. . | |
| 3,833,875 | 9/1974 | Holoka | 337/269 |
| 3,935,553 | 1/1976 | Kozacka et al. . | |
| 4,081,779 | 3/1978 | Ranzanigo | 337/198 |
| 4,082,408 | 4/1978 | Angelis | 339/198 G |
| 4,164,726 | 8/1979 | Weibe . | |
| 4,300,281 | 11/1981 | Panaro . | |
| 4,308,516 | 12/1981 | Shimada et al. . | |
| 4,344,058 | 8/1982 | Knapp, Jr. et al. . | |
| 4,365,226 | 12/1982 | Barry et al. . | |
| 4,391,485 | 7/1983 | Urani | 339/191 |
| 4,414,526 | 11/1983 | Panaro . | |
| 4,559,504 | 12/1985 | Krec . | |

(List continued on next page.)

FOREIGN PATENT DOCUMENTS 680901 10/1952 United Kingdom .

*Primary Examiner*—Leo P. Picard
*Assistant Examiner*—Anatoly Vortman
*Attorney, Agent, or Firm*—Armstrong Teasdale LLP

[57] ABSTRACT

A fuse system includes a fuse holder having an outer surface; a pair of fuse clips mounted inside the fuse holder, the pair of fuse clips being recessed from the outer surface of the fuse holder a predetermined distance; an insulative fuse housing; a fuse element mounted within the insulative fuse housing; blade terminals electrically connected to the fuse element and extending from the fuse housing; and an insulative sleeve on each of the blade terminals, the insulative sleeves extending from the fuse housing and covering a portion of each of the respective blade terminals and leaving a remaining portion of the blade terminals exposed; wherein the exposed portions of the blade terminals are less than the predetermined distance so that when the blade terminals make an electrical contact with the fuse clips, the exposed portions of the blade terminals are within the fuse holder and only the insulative sleeves are exposed. The fuse system also includes a projection on one of the fuse clips and the blade terminals and a recess in another of the fuse clips and the blade terminals, wherein the recess is sized so as to receive the projection.

33 Claims, 4 Drawing Sheets

U.S. PATENT DOCUMENTS 4,635,023 1/1987 Oh ..... 337/163
4,751,489 6/1988 Spaunhorst .
4,782,317 11/1988 Thwaites .
4,949,062 8/1990 Mollet .
4,949,063 8/1990 Levko .
4,951,026 8/1990 Ehlmann .
4,972,170 11/1990 Ehlmann et al. .
4,992,770 2/1991 Spalding et al. .
4,994,779 2/1991 Douglass .
5,002,505 3/1991 Jones et al. .
5,075,664 12/1991 Spalding et al. .
5,077,534 12/1991 Douglass .
5,150,093 9/1992 Gurevich .
5,229,739 7/1993 Oh et al. .
5,235,306 8/1993 Kalra et al. .
5,239,291 8/1993 Henricks et al. .
5,296,832 3/1994 Perreault et al. .
5,318,462 6/1994 Oakley ..... 439/716
5,345,211 9/1994 Muramatsu et al. .
5,357,234 10/1994 Pimpis et al. .
5,406,244 4/1995 Thwaites et al. .
5,418,515 5/1995 Reyes .
5,426,411 6/1995 Pimpis et al. .

TOUCH SAFE FUSE MODULE AND HOLDER

BACKGROUND OF THE INVENTION

1. Field of the Invention

The present invention relates to a touch safe fuse system.

2. Description of Related Art

Traditional fuse protection systems employ cylindrical cartridge fuses having cylindrical contact areas at each end thereof that are engaged to metal clips on a corresponding fuse holder. The contacts and fuse clips generally provide exposed metal surfaces that constitute an electrical safety hazard. Specifically, the contacts and fuse clips are traditionally exposed and are subject to be accidentally touched by humans or may enable a short circuit to be inadvertently created if a metal piece contacts two adjacent surfaces.

Recently, advances have been made to provide safer fuse systems that reduce the likelihood of an operator inadvertently touching a live surface of the fuse. See, e.g., U.S. Pat. No. 5,841,337, the subject matter of which is hereby incorporated herein by reference.

However, several improvements have been made to the fuse system disclosed in the '337 patent.

OBJECTS AND SUMMARY

An object of the present invention is to provide a safety fuse and holder that is safe to touch. Another object of the present invention is to provide a fuse that makes good electrical contact with a fuse holder, and which provides a secure retention of the fuse within the fuse holder.

It is still yet another object of the present invention to provide a fuse system having means for prohibiting a fuse of one ampere rating from being engaged with a fuse holder of a lower ampere rating.

It is still yet another object of the present invention to provide a fuse system that enables a plurality of fuses of different sizes to be ganged together.

The foregoing objects of the present invention are effected by providing a fuse system that includes a fuse holder having an outer surface, a pair of fuse clips mounted inside the fuse holder, the pair of fuse clips being recessed from the outer surface of the fuse holder a predetermined distance, an insulator fuse housing, a fuse element mounted within the insulator fuse housing, blade terminals electrically connected to the fuse element and extending from the fuse housing, and an insulative sleeve on each of the blade terminals, the insulative sleeves extending from the fuse housing and covering a portion of each of the respective blade terminals and leaving a remaining portion of the blade terminals exposed, wherein the exposed portions of the blade terminals are less than the predetermined distance so that when the blade terminals make an electrical contact with the fuse clips, the exposed portions of the blade terminals are within the fuse holder and only the insulative sleeves are exposed.

Another fuse system according to the present invention includes a fuse holder, a pair of fuse clips mounted in the fuse holder, a fuse having blade terminals, a projection on one of the fuse clips and the blade terminals, and a recess in another of the fuse clips and the blade terminals, wherein the recess is sized so as to receive the projection.

The fuse system of the present invention further includes fuse holders having means for enabling the fuse holder to be engaged with a fuse of a same or lower ampere rating and each of the fuse holders having a means for prohibiting the fuse holder to be engaged with a fuse of a higher ampere rating.

DETAILED DESCRIPTION OF THE PREFERRED EMBODIMENTS

Figure 1:
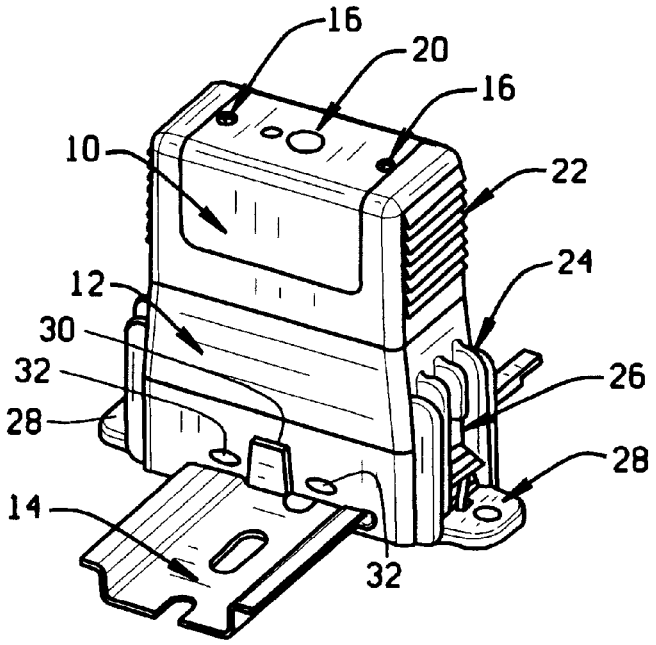
FIG. 1 is a perspective view of one embodiment of the fuse system of the present invention mounted on a DIN rail.
Figure 2:
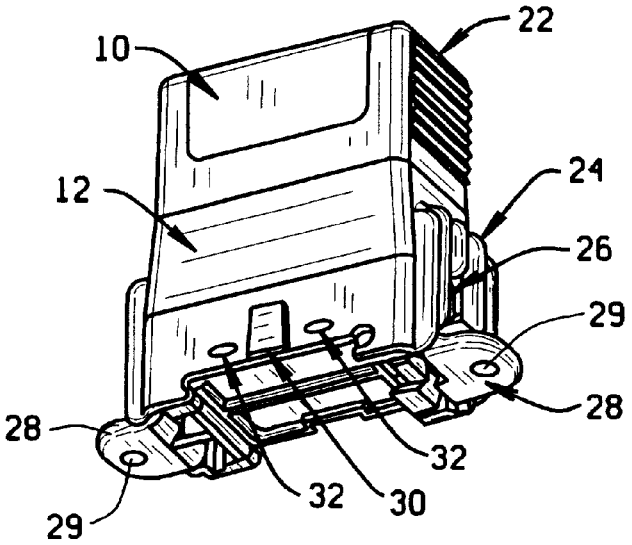
FIG. 2 is a perspective view of the embodiment of FIG. 1 without the DIN rail.

FIG. 1 is a perspective view of a fuse 10 engaged with a fuse holder 12 according to the present invention. The fuse holder 12, is illustrated, is engaged to a standard 35 millimeter DIN rail 14. Although the fuse 10 of the present invention may include any type of fuse element therein, in a preferred embodiment of the present invention, the fuse element within the fuse 10 is the same as disclosed in U.S. Pat. No. 5,841,337, which, as previously indicated, is incorporated herein by reference.

The fuse 10 also includes an open fuse indicator 20 mounted at a top portion thereof. Any suitable open fuse indicator may be used with the present invention, one example of which may be found in U.S. Pat. No. 5,841,337.

The fuse 10 includes ribbed edges 22 which facilitate grasping the fuse 10 for insertion or extraction.

The fuse 10 also includes test probe contact points 16. The contact points 16, include openings in the fuse 10 housing which enable test probes to be inserted through the fuse housing to contact the fuse element contained within the fuse housing. The access points comply with the IEC 60529 standard for an IP20 code rating.

The fuse holder 12 includes barrier fins 24 for providing adequate spacing. Specifically, the North American electrical distribution equipment industry is governed by specific Underwriters Laboratory standards that specify the wiring spacing or the spacing between adjacent metal surfaces of opposite polarity. The Underwriters Laboratory standard number UL98 for enclosed and dead front switches is one such standard, and specifies minimum spacing dimensions for through air and over surface paths between uninsulated live (energized) metal parts of opposite polarity. For a system voltage of 600 volts, the current minimum through air spacing is 1 inch, and the minimum over surface spacing is 2 inches. For example, the over surface distance between wires connected to adjacent fuse holders includes both sides of each of the fins between the wires. Accordingly, the barrier fins 24 provide the two inch spacing required by the UL standard number UL98.

Figure 6:
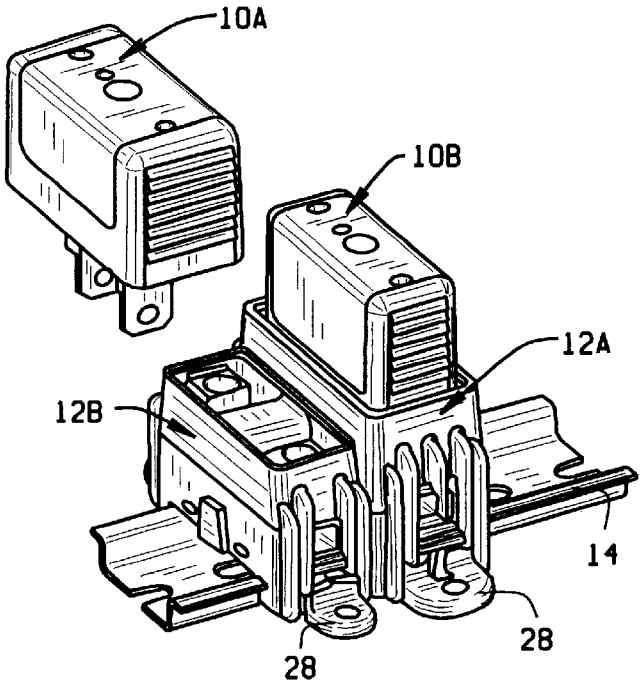
FIG. 6 is a perspective view of two fuse holders and two fuses of different sizes.

The fuse holder housing 42 also includes a dove tail 30 on one side thereof, and a corresponding dove tail slot (not shown) on the opposite side thereof. The fuse holder housing also includes detents 32 which engage with complementary detents on the opposite side of the fuse holder housing 42 to provide a snap feature when multiple fuse holders are ganged together, such as illustrated in FIG. 6. In a preferred embodiment of the present invention, the dove tail slot and detent features are made of the same size, regardless of the size or ampere rating of the fuse holder. Accordingly, a plurality of fuse holders, even those of different sizes or ampere ratings, may be dove tailed together.

The fuse holder 12 includes a plurality of chassis mounting bosses 28. Each of the bosses 28 includes a through hole 29, thus enabling the fuse holder 12 to be bolted to a surface, if desired.

Figure 3:
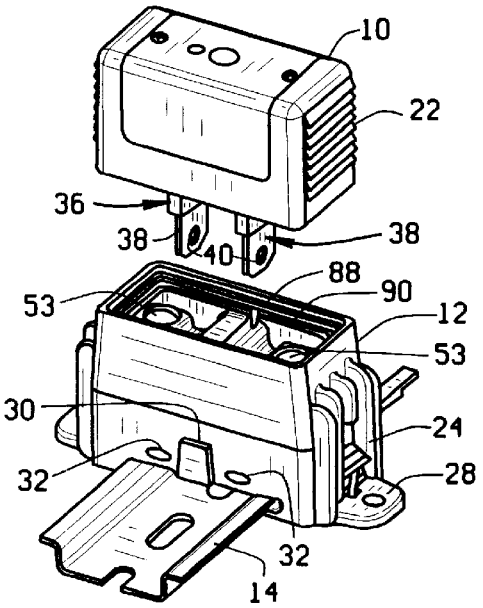
FIG. 3 is a perspective view of the embodiment shown in FIG. 1 with the fuse separated from the fuse holder.
Figure 4:
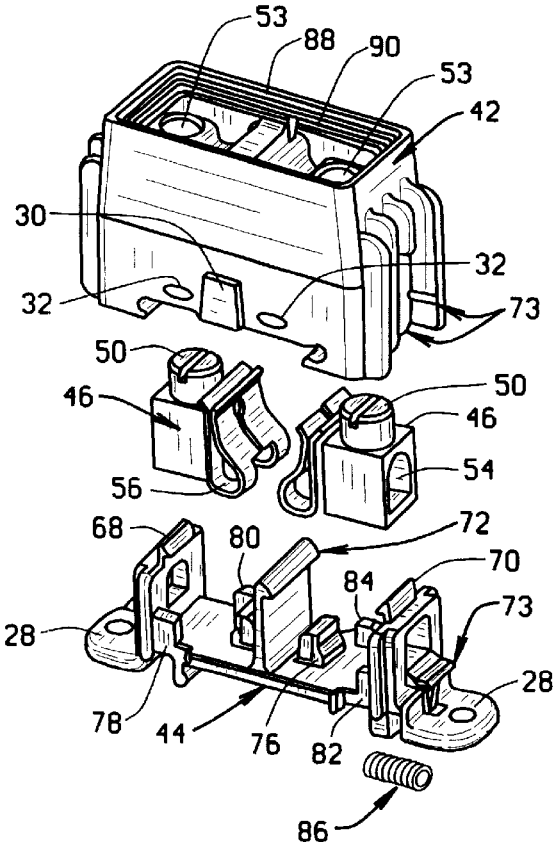
FIG. 4 is an exploded, perspective view of the fuse holder of the fuse system of the present invention.

Turning attention to FIGS. 3 and 4, further details of the fuse holder 12 can be seen. Specifically, the fuse holder cover 42 is secured to a fuse holder base 44 with snap features 72, 73. Secured to the fuse holder base 44 are wiring box lugs 46. The lugs 46 are secured to the fuse holder base 44 by wall features 78, 80, 82, 84. The wiring box lugs 46 are also secured in their respective locations by snap features 68, 70.

Each of the wiring box lugs 46 includes a wire receiving opening 54 and a bolt 50 for securing an external wire to the fuse holder 12.

Figure 7:
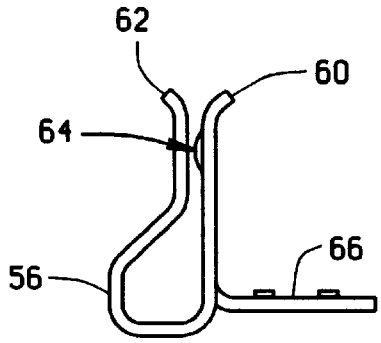
FIG. 7 is a side view of a fuse clip as used in the present invention.
Figure 8:
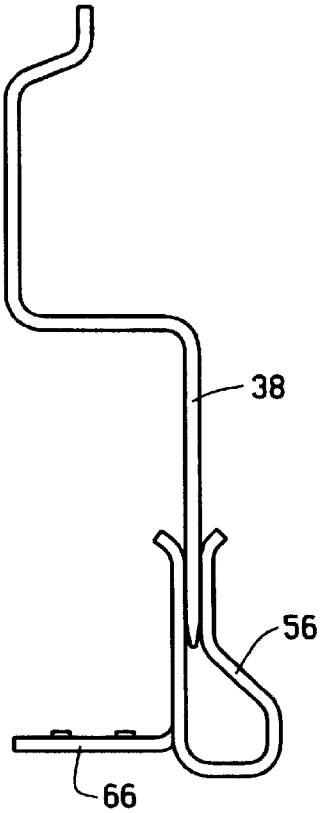
FIG. 8 is a side view illustrating a blade terminal engaged with a fuse clip of the present invention.

In addition, each of the wiring box lugs 46 includes a wiring clip 56. See FIGS. 7 and 8 for detailed side views of the wiring clips 56. As can be seen in FIG. 7, each of the fuse clips 56 includes a bump or projection 64 at a fixed location thereon. The projection 64 is intended to mate with apertures or recesses 40 in the respective blade terminals 38 so that when the fuse 10 is engaged with the fuse holder 12, the projection 64 fits within the aperture 40, as illustrated in FIG. 8. This detent feature provides an audible click so that when the fuse is being inserted into the fuse holder, the operator can tell when the fuse has been fully inserted therein. In addition, the detent feature provides a resistance fit which reduces the likelihood that the fuse 10 will be inadvertently removed from the fuse holder 12.

In another aspect of the present invention, the fuse holder 12 may be configured with a locking mechanism. Instead of having a projection 64 on the fuse clip, the fuse holder 12 will be operated in conjunction with a switch, so that when the switch is in the on position, a bar or pin within the fuse holder 12 will slide into the aperture 40, thus preventing removal of the fuse 10 while the switch is on.

An additional safety feature of the present invention includes insulation sleeves 36 on the blade terminals 38. In conjunction with the insulation sleeves 36, the fuse clips 56 are recessed within the fuse holder cover 42 by a predetermined distance. The insulation sleeves 36 extend from the fuse housing a sufficient distance such that the exposed portion of the blade terminals 38 is less than the predetermined distance by which the fuse clips are recessed within the fuse holder cover 42. Thus, when the blade terminals 38 make contact with the fuse clips 56, only the insulating sleeves 36 are exposed.

When the fuse holder 12 is fully assembled, the fuse holder is wired in a conventional manner by inserting a wire through the wiring port 26 in the exterior of the fuse holder 12 into the cavity 54 of the wiring lug box 46. The wire is then clamped in place using a screwdriver to turn the wiring bolt 52 through a respective opening 53 in the top of the fuse holder cover 42. The fuse clip 56 includes a plate 66 that extends from the fuse clip 56 into the lug 46 so that when a wire is inserted into the wiring port 26, it makes a contact with the plate 66.

The present invention also includes a rejection feature. Specifically, the fuse holder cover 48 includes a plurality of rims 88, 90. In addition, each fuse 10 is made to a predetermined size for a specific ampere rating, wherein a larger fuse 10 would correspond to a higher ampere rating. In addition, the terminal blades 38 are made proportional in size to the ampere rating, with a larger ampere rating having a larger fuse blade.

For example, in a preferred embodiment, the following dimensions (in inches) may be used for fuses of 30 amperes and 60 amperes:

| dimension | 30 amp fuse | 60 amp fuse |
|---|---|---|
| fuse block height | 1.00 | 1.13 |
| fuse block width | 1.82 | 2.07 |
| fuse block depth | 0.73 | 0.98 |
| sleeve length on blade | 0.20 | 0.29 |
| blade width | 0.31 | 0.44 |
| blade thickness | 0.04 | 0.04 |
| spacing between blades | 0.63 | 0.63 |
| width of blade receiving slot in fuse holder | 0.33 | 0.46 |

The openings in the fuse holder cover 42 which receive the terminal blades 38 of the fuse 10 are sized such that a fuse holder which is designed for a predetermined ampere rating will accept a fuse of a lower ampere rating, but will not accept a fuse of a higher ampere rating. In addition, because of the plurality of rims 88, 90, a fuse holder for a high ampere rating can accept a fuse 10 of a lower ampere rating. See FIG. 6, which illustrates a fuse holder 12A, which is rated for 60 amperes, having a fuse 10B of a 30 ampere rating engaged therewith. However, the 60 ampere fuse 10A will not fit in the 30 ampere fuse holder 12B. Note that in a preferred embodiment, the width of the terminal blades 38 of the 60 ampere fuse 10 is 0.44 inches and the width of the blade receiving slot in the 30 ampere fuse holder 12 is 0.33 inches.

Figure 5:
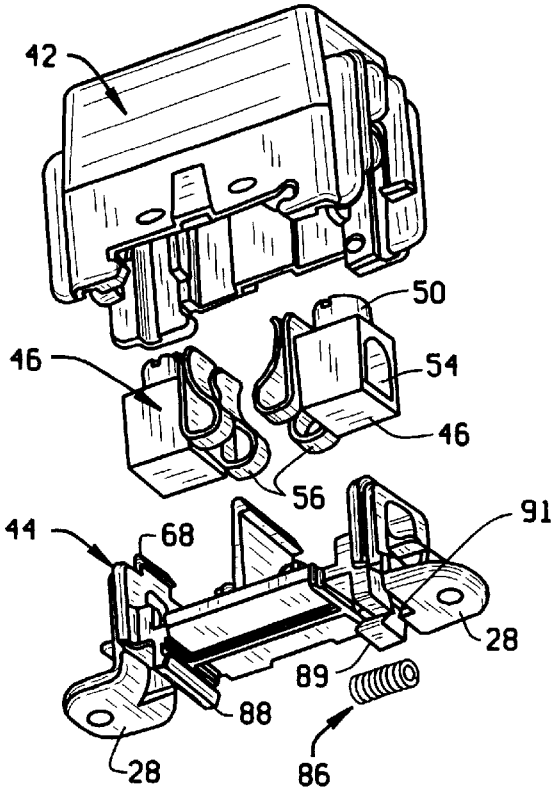
FIG. 5 is another exploded, perspective view of the fuse holder of FIG. 5.

Turning attention to FIG. 5, one edge of the DIN rail 14 engages with groove 88 of the fuse holder 12. The other edge of the DIN rail 14 engages with groove 89 of the fuse holder 12. In addition, a spring 86 is mounted to the underside of the base 44 with one end abutting against wall 91 and the other free to press against the second edge of the DIN rail 14. To mount the fuse holder 12 on the DIN rail 14, one edge of the DIN rail 14 is inserted into groove 89 and is pushed against the free end of the spring 86. When the spring 86 is compressed a certain amount, the other edge of the DIN rail 14 can slide into groove 88. To release the DIN rail 14, the DIN rail 14 is pushed against the spring 86 until the other edge of the DIN rail 14 can slide out of groove 88.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A fuse system comprising:

a fuse holder having an outer surface and having a size corresponding to an ampere rating of the fuse holder;

a pair of fuse clips mounted inside the fuse holder, said pair of fuse clips being recessed from the outer surface of the fuse holder a predetermined distance;

an insulative fuse housing;

a fuse element mounted within the insulative fuse housing, the size of the fuse housing corresponding to an ampere rating of the fuse element;

the fuse holder including a plurality of concentric rims for enabling the fuse holder to be engaged with a fuse housing of a lower ampere rating;

blade terminals electrically connected to the fuse element and extending from the fuse housing; and an insulative sleeve on each of the blade terminals, the insulative sleeves extending from the fuse housing and covering a portion of each of the respective blade terminals and leaving a remaining portion of the blade terminals exposed;

wherein the exposed portions of the blade terminals are less than the predetermined distance so that when the blade terminals make an electrical contact with the fuse clips, the exposed portions of the blade terminals are within the fuse holder and only the insulative sleeves are exposed.

2. The fuse system of claim 1, further comprising a projection on one of the fuse clips and the blade terminals; and a recess in another of the fuse clips and the blade terminals, wherein the recess is sized so as to receive the projection.

3. The fuse system of claim 2, wherein there is a projection on each of the fuse clips and a recess on each of the blade terminals.

4. The fuse system of claim 2, wherein there is a projection on each of the blade terminals and a recess on each of the fuse clips.

5. The fuse system of claim 2, wherein the projection and recess are sized such that an audible click is generated when the projection is inserted in the recess.

6. The fuse system of claim 2, wherein the projection and recess are sized such that an interference fit is created to retain the projection within the recess.

7. The fuse system of claim 1, further comprising a test probe opening in the fuse housing.

8. The fuse system of claim 1, further comprising two test probe openings in the fuse housing.

9. A fuse system comprising:

a fuse holder having a size corresponding to an ampere rating of the fuse holder and including a plurality of concentric rims of different sizes;

a pair of fuse clips mounted inside the fuse holder;

an insulative fuse housing;

a fuse element mounted within the insulative fuse housing, the size of the fuse housing corresponding to an ampere rating of the fuse element;

the concentric rims of the fuse holder and fuse housing sized to allow a fuse housing of a lower ampere rating than the fuse holder to be engaged with the fuse holder;

blade terminals electrically connected to the fuse element and extending from the fuse housing; and means mounted on the blade terminals for preventing an operator from contacting a live portion of the blade terminals when the blade terminals make an electrical contact with the fuse clips.

10. The fuse system of claim 9, further comprising a projection on one of the fuse clips and the blade terminals; and a recess in another of the fuse clips and the blade terminals, wherein the recess is sized so as to receive the projection.

11. The fuse system of claim 10, wherein there is a projection on each of the fuse clips and a recess on each of the blade terminals.

12. The fuse system of claim 10, wherein there is a projection on each of the blade terminals and a recess on each of the fuse clips.

13. The fuse system of claim 10, wherein the projection and recess are sized such that an audible click is generated when the projection is inserted in the recess.

14. The fuse system of claim 10, wherein the projection and recess are sized such that an interference fit is created to retain the projection within the recess.

15. The fuse system of claim 9, further comprising a test probe opening in the fuse housing.

16. The fuse system of claim 9, further comprising a test probe openings in the fuse housing.

17. A fuse system, comprising:

a fuse holder comprising a plurality of concentric rims;

a pair of fuse clips mounted in the fuse holder;

a fuse having blade terminals;

a projection on one of the fuse clips and the blade terminals; and a recess in another of the fuse clips and the blade terminals, wherein the recess is sized so as to receive the projection.

18. The fuse system of claim 17, wherein there is a projection on each of the fuse clips and a recess on each of the blade terminals.

19. The fuse system of claim 17, wherein there is a projection on each of the blade terminals and a recess on each of the fuse clips.

20. The fuse system of claim 17, wherein the projection and recess are sized such that an audible click is generated when the projection is inserted in the recess.

21. The fuse system of claim 17, wherein the projection and recess are sized such that an interference fit is created to retain the projection within the recess.

22. The fuse holder of claim 17, wherein the recess is on the blade terminals, and the fuse holder includes means for engaging the recess so as to lock the fuse in the fuse holder.

23. The fuse holder of claim 22, wherein the engaging means is activated by a switch.

24. The fuse system of claim 17, further comprising means mounted on the blade terminals for preventing an operator from contacting a live portion of the blade terminals when the blade terminals make an electrical contact with the fuse clips.

25. The fuse system of claim 22, further comprising means mounted on the blade terminals for preventing an operator from contacting a live portion of the blade terminals when the blade terminals make an electrical contact with the fuse clips.

26. A fuse system, comprising:

a plurality of fuse holders of different sizes, each of the fuse holders including a pair of fuse clips mounted inside the fuse holder, wherein the size of each fuse holder corresponds to an ampere rating of the fuse holder;

a plurality of fuses of different sizes, each of the fuses including an insulative fuse housing, a fuse element mounted within the insulative fuse housing, and blade terminals electrically connected to the fuse element and extending from the fuse housing, wherein the size of each fuse corresponds to an ampere rating of the fuse;

each the fuse holders including a plurality of concentric rims of different sizes for enabling the fuse holder to be engaged with a fuse of a lower ampere rating; and each the fuse holders including means for prohibiting the fuse holder to be engaged with a fuse of a higher ampere rating.

27. The fuse system of claim 26, wherein the prohibiting means includes:

an opening adjacent each fuse clip on each of the fuse holders, wherein a size of the opening is proportional to the ampere rating of the fuse holder; and the blade terminals of each of the fuses are proportional to the ampere rating of the fuses;

wherein the sizes of the fuse holder openings and the sizes of the blade terminals are selected such that the blade terminals of a fuse cannot fit into the openings of a fuse holder of a lower ampere rating.

28. The fuse system of claim 27, further comprising means mounted on the blade terminals for preventing an operator from contacting a live portion of the blade terminals when the blade terminals make an electrical contact with the fuse clips.

29. The fuse system of claim 26, further comprising a projection on one of the fuse clips and the blade terminals; and a recess in another of the fuse clips and the blade terminals, wherein the recess is sized so as to receive the projection.

30. The fuse system of claim 29, wherein there is a projection on each of the fuse clips and a recess on each of the blade terminals.

31. The fuse system of claim 29, wherein there is a projection on each of the blade terminals and a recess on each of the fuse clips.

32. The fuse system of claim 26, further comprising means for ganging together a plurality of fuse holders of different sizes.

33. The fuse system of claim 32, wherein the ganging means includes a dovetail on one side of each of the fuse holders and a dovetail slot on an opposite side of each of the fuse holders, wherein all of the dovetails are of a same size, regardless of the size of the fuse holder.

* * * * *